US010707066B2

(12) United States Patent
Miyauchi et al.

(10) Patent No.: US 10,707,066 B2
(45) Date of Patent: Jul. 7, 2020

(54) QUADRUPOLE MASS FILTER AND QUADRUPOLE MASS SPECTROMETROMETER

(71) Applicant: SHIMADZU CORPORATION, Kyoto-shi, Kyoto (JP)

(72) Inventors: Shinji Miyauchi, Kyoto (JP); Hiroko Ueda, Kyoto (JP); Yoshihiro Ueno, Kyoto (JP)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 0 days.

(21) Appl. No.: 15/780,932

(22) PCT Filed: Dec. 2, 2015

(86) PCT No.: PCT/JP2015/083915
§ 371 (c)(1),
(2) Date: Oct. 26, 2018

(87) PCT Pub. No.: WO2017/094146
PCT Pub. Date: Jun. 8, 2017

(65) Prior Publication Data

US 2019/0051508 A1 Feb. 14, 2019

(51) Int. Cl.
*H01J 49/00* (2006.01)
*H01J 49/42* (2006.01)
(Continued)

(52) U.S. Cl.
CPC ..... *H01J 49/4225* (2013.01); *H01J 49/065* (2013.01); *H01J 49/401* (2013.01); *H01J 49/4215* (2013.01)

(58) Field of Classification Search
CPC ..... H01J 49/42; H01J 49/4205; H01J 49/421; H01J 49/4215; H01J 49/4225
(Continued)

(56) References Cited

U.S. PATENT DOCUMENTS 3,129,327 A 4/1964 Brubaker
2004/0021072 A1* 2/2004 Soudakov ..... H01J 49/4215 250/292
(Continued)

FOREIGN PATENT DOCUMENTS

CA 2649031 A1 8/2008
CN 101005002 A 7/2007
(Continued)

OTHER PUBLICATIONS

Austin et al., "Chapter VI—the Mass Filter: Design and Performance, Quadrupole Mass Spectrometry and its Applications", Elsevier, 1976 (pp. 121-152).
(Continued)

*Primary Examiner* — Jason L McCormack
(74) *Attorney, Agent, or Firm* — Sughrue Mion PLLC

(57) ABSTRACT

Four main rod electrodes included in a main electrode section are disposed in a rotationally symmetric manner around an ion optical axis. Among four pre-rod electrodes included in a pre-electrode section disposed in front of the main electrode section, two are in contact with a circle of a radius $r_0$, whereas the other two are disposed to be in contact with a circle of a radius $R_0$ larger than $r_0$, resulting in rotational asymmetry around the ion optical axis. Accordingly, a shape of acceptance on an x-y plane regarding positions of ions in the pre-electrode section becomes elliptical. This allows the shape of the acceptance to become gradually flat as the ions travel along the ion optical axis, reducing a mismatch between emittance of incoming ions and the acceptance on a receiving side, and relieving ion loss during ion introduction.

4 Claims, 6 Drawing Sheets

(51) Int. Cl.
*H01J 49/06* (2006.01)
*H01J 49/40* (2006.01)

(58) Field of Classification Search
USPC ..... 250/281, 282
See application file for complete search history.

(56) References Cited

U.S. PATENT DOCUMENTS

| | | | | |
|---|---|---|---|---|
| 2008/0067364 | A1 | 3/2008 | Schwartz | |
| 2009/0321624 | A1 | 12/2009 | Fang et al. | |
| 2010/0012836 | A1* | 1/2010 | Mukaibatake ..... | H01J 49/022 250/292 |
| 2014/0284469 | A1* | 9/2014 | Langridge ..... | H01J 49/063 250/282 |

FOREIGN PATENT DOCUMENTS

| | | | |
|---|---|---|---|
| CN | 101443880 | A | 5/2009 |
| EP | 1930937 | A1 | 6/2008 |
| JP | 2005259616 | A | 9/2005 |
| JP | 2009506506 | A | 2/2009 |
| JP | 2009537953 | A | 10/2009 |

OTHER PUBLICATIONS

Brubaker, "An Improved Quadrupole Mass Analyser", Advances in Mass Spectrometry, vol. 4, 1968 (pp. 293-299).

Gerlich, "Inhomogeneous RF Fields: A Versatile Tool for the Study of Processes with Slow Ions", Advances in Chemical Physics Series, vol. LXXXII. ISBN 0-471-53258-4, John Wiley & Sons, Inc., 1992 (pp. 1-176).

Written Opinion of PCT/JP2015/083915 dated Feb. 16, 2016.

International Search Report of PCT/JP2015/083915 dated Feb. 16, 2016.

International Preliminary Report on Patentability with English Translation of the Written Opinion of PCT/JP2015/083915 dated Jun. 5, 2018.

* cited by examiner

QUADRUPOLE MASS FILTER AND QUADRUPOLE MASS SPECTROMETROMETER

CROSS REFERENCE TO RELATED APPLICATIONS

This application is a National Stage of International Application No. PCT/JP2015/083915, filed on Dec. 2, 2015.

TECHNICAL FIELD

The present invention relates to a quadrupole mass filter for selecting ions having a specified mass-to-charge ratio m/z and a quadrupole mass spectrometer using the quadrupole mass filter as a mass separator. Note that the quadrupole mass spectrometer mentioned here includes not only a general single quadrupole mass spectrometer using the quadrupole mass filter as an only mass separator, but also a triple quadrupole mass spectrometer including a two-stage quadrupole mass filter in order to perform MS/MS analysis, and a quadrupole time-of-flight (Q-TOF) mass spectrometer that dissociates ions selected by the quadrupole mass filter and then separates and detects the ions with a TOF mass separator according to a mass-to-charge ratio.

BACKGROUND ART

A single quadrupole mass spectrometer introduces, into a quadrupole mass filter, various ions generated from a sample, allows only ions having a specified mass-to-charge ratio to selectively pass, and detects the ions that have passed by using a detector to acquire an intensity signal according to an amount of ions.

Generally, a quadrupole mass filter includes four rod electrodes disposed in parallel with each other to surround an ion optical axis. A voltage obtained by adding a direct current voltage and a radio-frequency voltage (alternating current voltage) is applied to each of the four rod electrodes. The mass-to-charge ratio of ions that can pass through the space surrounded by the four rod electrodes in the axial direction of the space depends on the radio-frequency voltage and the direct current voltage applied to the rod electrodes. Therefore, by appropriately setting the radio-frequency voltage and the direct current voltage according to the mass-to-charge ratio of ions to be measured, it is possible to pass the ions to be measured, and to detect the ions. In addition, by changing the radio-frequency voltage and the direct current voltage to be applied to the rod electrodes while maintaining a predetermined relationship between them within a predetermined range, it is possible to scan the mass-to-charge ratio of the ions passing through the quadrupole mass filter in a predetermined range and to create a mass spectrum on a basis of signals obtained from the detector.

The operating conditions in which ions pass stably and the behavior of ions in a quadrupole electric field generated in the space surrounded by the rod electrodes by the voltage applied to the rod electrodes constituting the quadrupole mass filter are conventionally analyzed in detail, as described in Non Patent Literature 1 and other literatures.

That is, movement of ions passing through an ideal quadrupole electric field generated in the space surrounded by the rod electrodes extending in the z axis is represented by the following Equations (1) which are called the Mathieu equations.

$$m(d^2x/dt^2)=-(2zex/r_0^2)(U-V\cos\Omega t)$$

$$m(d^2y/dt^2)=-(2zey/r_0^2)(U-V\cos\Omega t) \quad (1)$$

Here, m is the mass of an ion, $r_0$ is the radius of the circle inscribing the rod electrodes, e is the electric charge, U is the direct current voltage value, V is the amplitude of the radio-frequency voltage, and Ω is the frequency of the radio-frequency voltage. Further, z represents a position on the z axis, and x and y respectively represent positions on the x axis and the y axis which are both orthogonal to the z axis.

Conditions that ions can pass stably within the space surrounded by the four rod electrodes can be demonstrated by the following Equations (2) which represent a region on a two-dimensional space with the following two parameters a and q obtained by solving the Matthew equation set as axes orthogonal to each other.

$$a_x=-a_y=8\ eU/mr_0^2\Omega^2$$

$$q_x=-q_y=4\ eV/mr_0^2\Omega^2 \quad (2)$$

FIG. 11 (*a*) is the stable state diagram often used to describe a stability condition for a solution to the Matthew equation. In FIG. 11 (*a*), the nearly triangular region surrounded by the solid lines is the stable region represented by the stable solution of Equation (1), and the outside of the triangular region is an unstable region in which ions disperse. Theoretically, ions having a certain mass can pass stably if conditions including voltage are set so that the ions are positioned anywhere within the stable region. But, in order to obtain high mass resolution, it is necessary to set the operating conditions at a position close to the top P of the stable region. Therefore, in general, the operating conditions are determined, for example, near a point A close to the top P in order to maintain high mass resolution and to prevent the ions from entering the unstable region even if the operating conditions deviate or fluctuate.

However, in actual measurement by the quadrupole mass spectrometer, ions generated outside the quadrupole mass filter enter the space surrounded by the rod electrodes via an end (entrance) part of the space. The electric field at the end part, that is, an edge end electric field, is weaker than the quadrupole electric field generated within the space. Therefore, behavior of the ions entering the quadrupole mass filter, which is caused by the electric field experienced by the ions, can be shown on the stable state diagram by the dotted line arrow in FIG. 11 (*a*), that is, the ions enter the stable region after passing through the unstable region. Since movement of the ions is unstable while passing through the unstable region B in the diagram, part of the ions disperse and disappear before reaching the stable quadrupole electric field. This is a major factor of a decrease in the passing efficiency of ions passing through the quadrupole mass filter.

In order to solve the above-described problem in many quadrupole mass spectrometers, the quadrupole mass filter employs a configuration in which, just in front of a main electrode section composed of four main rod electrodes for selecting ions according to the mass-to-charge ratio, a pre-electrode section composed of four pre-rod electrodes having the same diameter as that of the main rod electrode and a length shorter than that of the main rod electrodes is disposed, and the same radio-frequency voltage as that applied to the main rod electrodes is applied to the pre-rod electrodes (see Patent Literatures 1 and 2, Non Patent Literature 2, and other literatures). The direct current voltage applied to the main rod electrodes for ion selection is not applied to this pre-rod electrodes. Therefore, as described in Patent Literature 2, behavior of the ions first passing through the space surrounded by the pre-rod electrodes and then entering the space surrounded by the main rod electrodes can be shown on the stable state diagram by the dotted line arrow in FIG. 11 (*b*), that is, ions reach the point A while passing through the stable region. In this case, since the ions do not pass through the unstable region, the ions are efficiently introduced into the space surrounded by the main rod electrodes, and ion passing efficiency can be improved compared with a case where the pre-rod electrodes are not provided.

However, according to the present inventors' simulation calculations and other studies, even for the above-described quadrupole mass filter provided with the pre-rod electrodes, most of the ions entering the quadrupole mass filter are not used, and still much improvement should be done in the ion passing efficiency. In recent years, in the field of mass spectrometry, identification and measurement of components contained in a sample in very small quantities are becoming increasingly necessary. In order to meet such a request, further improvement in detection sensitivity is necessary. For the quadrupole mass spectrometer equipped with the quadrupole mass filter, it is very important to improve the ion passing efficiency of the quadrupole mass filter.

CITATION LIST

Patent Literature

Patent Literature 1: U.S. Pat. No. 3,129,327
Patent Literature 2: JP 2005-259616 A

Non Patent Literature

Non Patent Literature 1: Austin WE and two others, "CHAPTER VI-THE MASS FILTER: DESIGN AND PERFORMANCE, Quadrupole Mass Spectrometry and its Applications". Elsevier, 1976

Non Patent Literature 2: Wilson M. Brubaker, "An Improved Quadrupole Mass Analyser", Advances in Mass Spectrometry, Vol. 4, 1968, pp. 293-299

Non Patent Literature 3: Dieter Gerlich, "Inhomogeneous RF Fields: A Versatile Tool for the Study of Processes with Slow Ions", John Wiley & Sons. Inc., 1992

SUMMARY OF INVENTION

Technical Problem

The present invention has been made to solve the above-described problem, and an object of the present invention is to provide a quadrupole mass filter that can improve the passing efficiency of ions to be measured. In addition, another object of the present invention is, by using such a quadrupole mass filter with high ion passing efficiency, to provide a quadrupole mass spectrometer that can increase the amount of ions that finally reach a detector and achieve high detection sensitivity.

Solution to Problem

Generally, a radio-frequency voltage to be applied to rod electrodes of a main electrode section is set such that ions having a mass-to-charge ratio that is aimed to pass (that should be selected) can pass well, that is, the amount of passing ions is as much as possible (actually, the ion intensity detected becomes as high as possible). In addition, the radio-frequency voltage identical to the radio-frequency voltage applied to the rod electrodes of the main electrode section is applied to the rod electrodes included in the pre-electrode section. With this configuration, the above-described ions having the mass-to-charge ratio that is aimed to pass can also pass well through the rod electrodes included in the pre-electrode section. However, introduction efficiency of ions when the ions emitted from the rod electrodes included in the pre-electrode section enters the space surrounded by the rod electrodes included in the main electrode section depends on matching characteristic between an emittance of incoming ion beams and an acceptance on a receiving side. When the matching characteristic is bad, part of the incoming ions will be dispersed. Conventionally such matching characteristic has seldom been taken into consideration when an overall ion passing efficiency was intended to increase, but high ion passing efficiency only in the space surrounded by the rod electrodes described above has been considered important. In contrast, while repeating simulation calculations and study under various conditions, the present inventors have obtained findings that the ion introduction efficiency when the ions that have passed through the pre-rod electrodes enter the space surrounded by the main rod electrodes is important for increasing the overall ion passing efficiency.

In order to increase the ion introduction efficiency when the ions enter the main electrode section, it is necessary to at least improve the matching characteristic between the emittance regarding the position of incoming ions and the acceptance regarding the position of ions on a receiving side. However, it is difficult to change the emittance regarding the ion position of the ions entering the quadrupole mass filter because this leads to a change in a configuration or structure of the entire mass spectrometer. Meanwhile, it is also difficult to change the acceptance regarding the ion position in the main electrode section because this may decrease passing efficiency of ions passing through the main electrode section. Therefore, the present inventors have studied the configuration and structure of the electrodes of the pre-electrode section, and conditions such as voltages applied on them, have confirmed that it is possible by determining them appropriately to improve the matching characteristic and to enhance the overall ion passing efficiency, and then have achieved the present invention.

That is, a quadrupole mass filter of a first aspect according to the present invention that has been made to solve the above-described problem includes:

a) a main electrode section including four main rod electrodes disposed to surround a central axis:

b) a pre-electrode section including pre-rod electrodes shorter than the main rod electrodes, the pre-rod electrodes being disposed in front of the main rod electrodes of the main electrode section along the central axis:

c) a first voltage application unit configured to apply, to each of the main rod electrodes, a voltage obtained by adding a direct current voltage and a radio-frequency voltage according to a mass-to-charge ratio of ions that are allowed to pass; and d) a second voltage application unit configured to apply, to each of the pre-rod electrodes, a radio-frequency voltage identical to the radio-frequency voltage in frequency, wherein in the pre-electrode section, first two of the pre-rod electrodes positioned so as to sandwich the central axis and second two of the pre-rod electrodes adjacent to the first two of the pre-rod electrodes around the central axis are disposed at positions where radii of inscribed circles centered on the central axis differ.

A quadrupole mass filter of a second aspect according to the present invention that has been made to solve the above-described problem includes:

a) a main electrode section including four main rod electrodes disposed to surround a central axis;

b) a pre-electrode section including pre-rod electrodes shorter than the main rod electrodes, the pre-rod electrodes being disposed in front of the main rod electrodes of the main electrode section along the central axis;

c) a first voltage application unit configured to apply, to each of the main rod electrodes, a voltage obtained by adding a direct current voltage and a radio-frequency voltage according to a mass-to-charge ratio of ions that are allowed to pass; and d) a second voltage application unit configured to apply, to each of the pre-rod electrodes, a radio-frequency voltage identical to the radio-frequency voltage in frequency, wherein in the pre-electrode section, first two of the pre-rod electrodes positioned so as to sandwich the central axis and second two of the pre-rod electrodes adjacent to the first two of the pre-rod electrodes around the central axis have different sectional shapes of curved surfaces facing the central axis.

Specifically, a configuration may be used in which, for example, in the pre-rod electrodes, the sectional shapes of the curved surfaces facing the central axis are all arc-shaped, and the first two of the pre-rod electrodes positioned so as to sandwich the central axis and the second two of the pre-rod electrodes adjacent to the first two of the pre-rod electrodes around the central axis have different radii of the arcs.

Alternatively, a configuration may be used in which the sectional shapes of the curved surfaces facing the central axis of the first two of the pre-rod electrodes positioned so as to sandwich the central axis are arc-shaped, and the sectional shapes of the curved surfaces facing the central axis of the second two of the pre-rod electrodes adjacent to the first two of the pre-rod electrodes around the central axis are elliptical arc-shaped.

A quadrupole mass filter of a third aspect according to the present invention that has been made to solve the above-described problem includes:

a) a main electrode section including four main rod electrodes disposed to surround a central axis;

b) a pre-electrode section including pre-rod electrodes shorter than the main rod electrodes, the pre-rod electrodes being disposed in front of the main rod electrodes of the main electrode section along the central axis:

c) a first voltage application unit configured to apply, to each of the main rod electrodes, a voltage generated by adding a direct current voltage and a radio-frequency voltage according to a mass-to-charge ratio of ions that are allowed to pass; and d) a second voltage application unit configured to apply radio-frequency voltages having a frequency identical to a frequency of the radio-frequency voltage and having amplitudes different from each other to first two of the pre-rod electrodes positioned so as to sandwich the central axis and to second two of the pre-rod electrodes adjacent to the first two of the pre-rod electrodes around the central axis.

A quadrupole mass spectrometer according to the present invention that has been made to solve the above-described problem uses the quadrupole mass filter according to the present invention as at least one mass separator.

In general quadrupole mass filters, placement and shapes of the pre-rod electrodes included in the pre-electrode section, or voltages to be applied to the pre-electrode section are completely rotationally symmetric around the central axis. Therefore, the acceptance regarding the ion position in the space surrounded by the pre-rod electrodes to which a direct current voltage for mass separation is not applied is circular (in the following description, unless otherwise described, the acceptance refers to acceptance regarding the ion position, and the emittance refers to emittance regarding the ion position). Meanwhile, since not only the radio-frequency voltage for mass separation but also the direct current voltage for mass separation is applied to the main rod electrodes, the acceptance in the space surrounded by the main rod electrodes is elliptical due to the influence of such voltage application. The sectional shape of an ion beam that is sent from the pre-electrode section to the main electrode section, that is, the emittance shape of the pre-electrode section, which is identical to the shape of acceptance (acceptance shape) in the pre-electrode section, is circular. That is, in the conventional quadrupole mass filter, a large mismatch arises between the emittance in the pre-electrode section and the acceptance in the main electrode section.

In contrast, in the quadrupole mass filter according to the present invention, placement and shapes of the pre-rod electrodes included in the pre-electrode section, or voltages to be applied to the pre-rod electrodes are not completely rotationally symmetric around the central axis. Therefore, the acceptance and the emittance of ions in the pre-electrode section are also not circular but elliptical. Ellipticity of this ellipse (minor diameter/major diameter) depends on the degree of rotational asymmetry around the central axis. Therefore, placement and shapes of the pre-rod electrodes, or voltages to be applied to the pre-rod electrodes are determined such that ellipticity of the acceptance shape in the pre-electrode section is between ellipticity of the acceptance shape in the main electrode section and ellipticity of the circular emittance shape of ions generally entering the quadrupole mass filter, that is 1. That is, when ellipticity of the acceptance shape in the main electrode section is a (<1) and ellipticity of the acceptance shape in the pre-electrode section is b (<1), it is only necessary to set $a<b<1$.

Accordingly, although the emittance shape of ions entering the quadrupole mass filter is circular, the acceptance shape becomes elliptical in the pre-electrode section and more elliptical in the main electrode section, which reduces the mismatch between the emittance shape and the acceptance shape. As a result, loss of ions when the ions enter the main electrode section from the pre-electrode section becomes less than in the conventional quadrupole mass filter. Thus, even if the loss of ions increases when ions enter the pre-electrode section from the outside of the quadrupole mass filter, the overall passing efficiency of ions with respect to the entire quadrupole mass filter improves.

Advantageous Effects of Invention

As described above, the quadrupole mass filter according to the present invention can improve the ion passing efficiency of ions to be selected, and can send a larger amount of ions to a subsequent stage.

In addition, the quadrupole mass spectrometer according to the present invention can allow more target ions from a sample to reach the detector, and can make more ions dissociated in a collision cell or the like to mass analyze product ions produced thereby. Since detection sensitivity of the target ions from a sample improves accordingly, the quadrupole mass spectrometer according to the present invention is useful for identification and measurement of minor components, or for structural analysis.

BRIEF DESCRIPTION OF DRAWINGS

FIG. 11(*b*) is a stable region diagram showing motion conditions of ions passing through the quadrupole mass filter in a configuration in which the pre-rod electrodes are provided.

DESCRIPTION OF EMBODIMENTS

First Embodiment

A first embodiment of a mass spectrometer using a quadrupole mass filter according to the present invention will be described with reference to the accompanying drawings.

Figure 1:
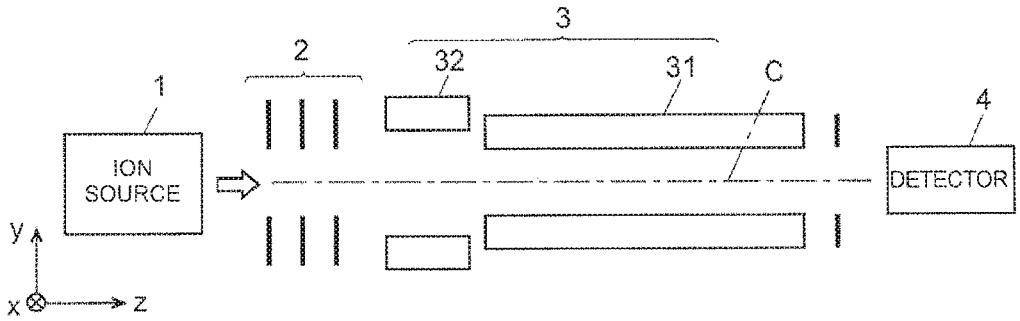
FIG. 1 is a schematic configuration diagram of a first embodiment of a quadrupole mass spectrometer using a quadrupole mass filter according to the present invention.
Figure 2:
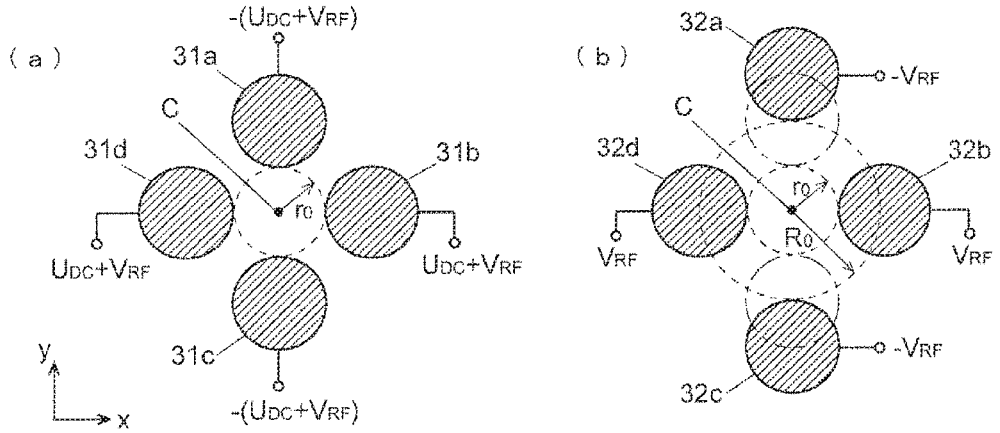
FIG. 2 is a longitudinal sectional view of main rod electrodes and pre-rod electrodes in the mass spectrometer of the first embodiment.

FIG. 1 is a schematic configuration diagram of a single type quadrupole mass spectrometer, which is the first embodiment. FIG. 2 is a longitudinal sectional view of a main electrode section and a pre-electrode section in the quadrupole mass spectrometer of the present embodiment.

The quadrupole mass spectrometer of the present embodiment includes an ion source 1, an ion lens 2, a quadrupole mass filter 3, and a detector 4 inside an unillustrated vacuum chamber. The ion source 1 ionizes sample components within a sample gas, for example, by electron ionization. Ions generated by the ion source 1 and pulled out rightward as shown with an outlined arrow in FIG. 1 are converged by the ion lens 2 and introduced into the quadrupole mass filter 3. As will be described later, the quadrupole mass filter 3 includes a main electrode section 31 including four rod electrodes and a pre-electrode section 32 disposed in a preceding stage of the main electrode section 31.

As will be described in detail later, among the ions introduced into a space of a longitudinal direction of the quadrupole mass filter 3 along an ion optical axis C, by an effect of an electric field generated by a radio-frequency voltage and a direct current voltage applied to the rod electrodes of the quadrupole mass filter 3, only ions having a specified mass-to-charge ratio pass near the ion optical axis C while vibrating, whereas other ions are dispersed halfway. The ions that have passed through the quadrupole mass filter 3 reach the detector 4. The detector 4 generates a detection signal according to an amount of reached ions, and sends the detection signal to an unillustrated data processing unit. When the radio-frequency voltage and the direct current voltage to be applied to the rod electrodes of the quadrupole mass filter 3 are each changed while a predetermined relationship is maintained, the mass-to-charge ratio of the ions that can pass through the quadrupole mass filter 3 will change. Therefore, by scanning each of the radio-frequency voltage and the direct current voltage in a predetermined range, it is possible to change the mass-to-charge ratio of the ions that can reach the detector 4 in a predetermined range, and on a basis of the detection signal obtained accordingly, it is possible to create a mass spectrum indicating a relationship between the mass-to-charge ratio and ion intensity.

As shown in FIG. 2 (*a*), the main electrode section 31 includes four cylindrical main rod electrodes (a, b, c, d) disposed in parallel with the ion optical axis C to surround the ion optical axis C which is also a central axis. Diameters of the main rod electrodes and a radius $r_0$ of a circle that is centered on the ion optical axis C and inscribed in the main rod electrodes are identical. Meanwhile, as shown in FIG. 2 (*b*), in a similar manner to the main electrode section 31, the pre-electrode section 32 includes four cylindrical pre-rod electrodes (a, b, c, d) disposed in parallel with the ion optical axis C to surround the ion optical axis C. Although diameters of the pre-rod electrodes are identical, radii of circles that are centered on the ion optical axis C and inscribed in the pre-rod electrodes differ between the pre-rod electrodes 32*a* and 32*c* and the pre-rod electrodes 32*b* and 32*d*. That is, the radius of the inscribed circle of the two pre-rod electrodes 32*b* and 32*d* is the same as the radius $r_0$ of the inscribed circle of the four rod electrodes constituting the main electrode section 31; however, the radius $R_0$ of the inscribed circle of the other two pre-rod electrodes 32*a* and 32*c* is larger than the radius $r_0$. Therefore, it can also be considered that the four pre-rod electrodes 32*a*, 32*b*, 32*c*, and 32*d* are circumscribed on a virtual elliptical pipe centered on the ion optical axis C.

Note that as is conventional, the voltage to be applied to the four pre-rod electrodes 32*a*, 32*b*, 32*c*, and 32*d* is the same as the radio-frequency voltage to be applied to the main rod electrodes 31*a* to 31*d* disposed behind respective pre-rod electrodes 32*a* to 32*d*. That is, a radio-frequency voltage $V_{RF}$ ($=V_1 \sin \Omega t$) is applied to the pre-rod electrodes 32*b* and 32*d*, whereas a radio-frequency voltage $-V_{RF}$ ($=-V_1 \sin \Omega t$) having a phase opposite to that of the radio-frequency voltage $V_{RF}$ and a frequency and amplitude identical to those of the radio-frequency voltage $V_{RF}$ is applied to the pre-rod electrodes 32*a* and 32*c*. In addition to these voltages, although not described in FIG. 2, a common direct current bias voltage is normally applied to all the pre-rod electrodes 32*a* to 32*d*.

In the quadrupole mass filter including the four rod electrodes completely rotationally symmetric around the central axis, potential in an x-y plane of a quadrupole electric field generated in the space surrounded by the rod electrodes is generally represented by Equation (3) below.

$$\varphi(x,y,t)=\{(x^2-y^2)/r_0^2\}(U_{DC}-V_{ACCOS}\Omega t) \tag{3}$$

Static potential in Equation (3) is represented by Equation (4).

$$V_s=\{(x^2-y^2)/r_0^2\}U_{DC} \tag{4}$$

In addition, the electric field by Equation (3) is represented by Equation (5).

[Formula 1]

$$E(x, y, t) = -\nabla\phi(x, y, t) = \frac{2(U_{DC} - V_{ACCOS}\,\Omega t)}{r_0^2}\begin{pmatrix} -x \\ y \\ 0 \end{pmatrix} \tag{5}$$

A dynamic electric field in Equation (5) is represented by Equation (6).

[Formula 2]

$$E_{AC} = \frac{2V_{AC}}{r_0^2}\begin{pmatrix} x \\ -y \\ 0 \end{pmatrix} \tag{6}$$

Pseudo-potential is represented by Equation (7).

[Formula 3]

$$\begin{aligned} V^* &= \frac{e\,\|E_{AC}\|^2}{4m\Omega^2} + V_s \\ &= \frac{eV_{AC}^2}{4m\Omega^2}(x^2+y^2) + (x^2-y^2)\frac{U_{DC}}{r_0^2} \\ &= \frac{m\Omega^2}{16e}\{(q^2+2a)x^2 + (q^2-2a)y^2\} \le E_{in} \\ &\Rightarrow \begin{cases} \left(\frac{x}{R_x}\right)^2 + \left(\frac{y}{R_y}\right)^2 \le 1 \\ R_x = \frac{4}{\Omega} + \sqrt{\frac{eE_{in}}{m(q^2+2a)}} \\ R_y = \frac{4}{\Omega} + \sqrt{\frac{eE_{in}}{m(q^2-2a)}} \end{cases} \end{aligned} \tag{7}$$

The right side of the first line of Equation (7) is based on description of Non Patent Literature 3. The second line of Equation (7) is based on Equation (2) indicating parameters of the stable region. In addition, $E_{in}$ is energy of incoming ions.

Equation (7) theoretically indicates that the acceptance shape in the x-y plane orthogonal to a z axis (ion optical axis C) is elliptical in the main electrode section including the four main rod electrodes. Meanwhile, a movement state of ions entering the quadrupole mass filter, that is, the emittance shape is almost circular. In the conventional quadrupole mass filter, the emittance shape of ions emitted from the pre-electrode section is also circular. It can be estimated that this difference between the sectional emittance shape of incoming ions and the sectional acceptance shape in the main electrode section is one of the large causes of a decline in ion introduction efficiency. In contrast, in the mass spectrometer of the present embodiment, since the pre-rod electrodes 32*a* to 32*d* in the pre-electrode section 32 are disposed to be circumscribed on an elliptical pipe centered on the ion optical axis C as described above, the acceptance shape in the pre-electrode section 32 is not circular but elliptical.

Figure 3:
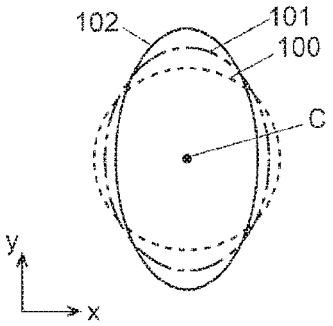
FIG. 3 is a schematic diagram showing shapes of emittance and acceptance in each stage of the quadrupole mass filter in the mass spectrometer of the first embodiment.

In addition, an outward shifted amount of the pre-rod electrodes 32*a* and 32*c* is determined such that ellipticity of the ellipse indicating the acceptance shape in the pre-electrode section 32 is larger than ellipticity of the ellipse indicating the acceptance shape in the main electrode section 31 (that is, close to circular). FIG. 3 shows a relationship among a sectional shape 100 of the emittance of the ions entering the pre-electrode section 32 through the ion lens 2, a sectional shape 101 of the acceptance in the pre-electrode section 32, and a sectional shape 102 of the acceptance in the main electrode section 31. Thus, in the mass spectrometer of the present embodiment, the acceptance shape does not change suddenly as in the conventional mass spectrometer, but as ions travel along the ion optical axis C, the acceptance shape changes gradually, that is, becomes flat. Therefore, the mismatch between the emittance of the incoming ions and the acceptance on a receiving side becomes small, relieving ion loss during ion introduction.

Figure 4:
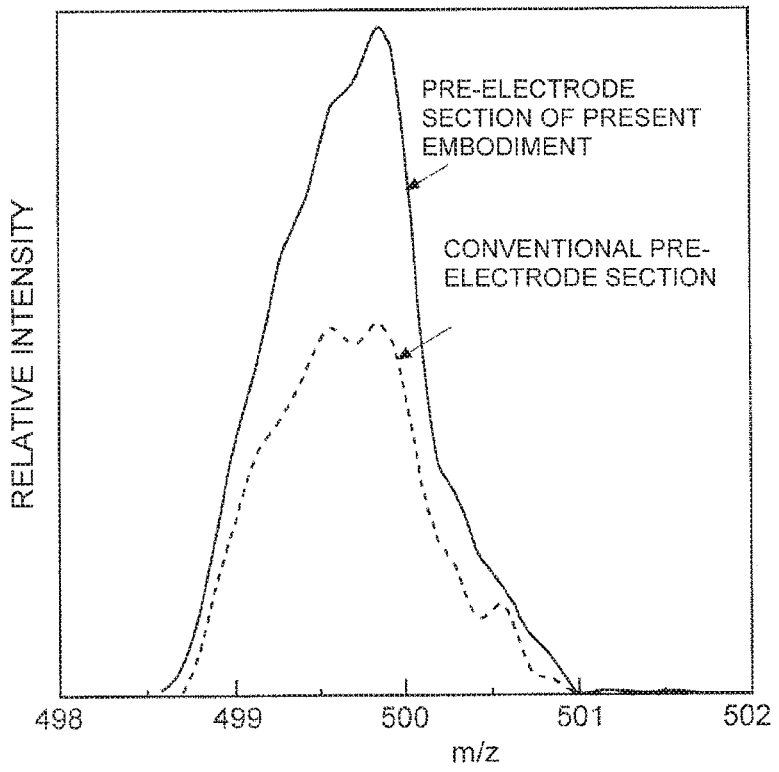
FIG. 4 is a diagram showing simulation results of relative ion intensity in the quadrupole mass filter in the mass spectrometer of the first embodiment and a conventional quadrupole mass filter.

FIG. 4 shows a comparison result of relative ion intensity by simulation calculations between the quadrupole mass filter used in the first embodiment and the conventional quadrupole mass filter. In this simulation, relative intensity of ions passing through the quadrupole mass filter 3 is calculated by calculating a locus of ions having m/z=500 and emitted from a predetermined position on the ion optical axis (z axis) C corresponding to a position of the ion source 1. As is apparent from FIG. 4, the relative intensity of the quadrupole mass filter 3 in the above embodiment is about 1.8 times the relative intensity of the conventional quadrupole mass filter. That is, it can be said that an amount of ions reaching the detector 4 is nearly doubled, and detection sensitivity improves accordingly.

Second Embodiment

Figure 5:
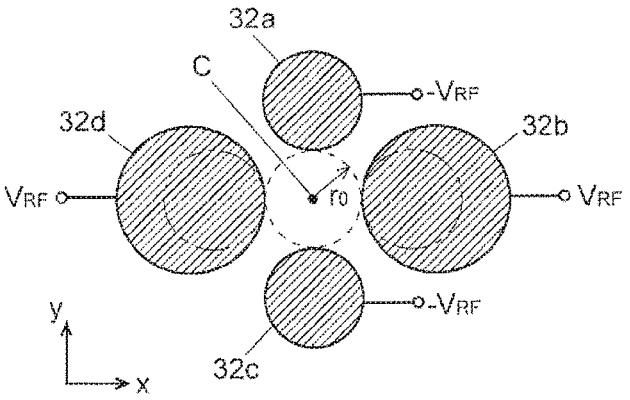
FIG. 5 is a longitudinal sectional view of pre-rod electrodes in a mass spectrometer of a second embodiment.

FIG. 5 is a longitudinal sectional view of a pre-electrode section 32 in a mass spectrometer that is another embodiment (second embodiment) of the present invention. A configuration other than the pre-electrode section 32 is completely the same as the configuration of the first embodiment. In this mass spectrometer of the second embodiment, all of four pre-rod electrodes 32*a* to 32*d* are in contact with a circle having a radius of $r_0$, but a radius of the pre-rod electrodes 32*a* and 32*c* differs from a radius of the pre-rod electrodes 32*b* and 32*d*. That is, sectional arc shapes of curved surfaces of the pre-rod electrodes 32*a* to 32*d* facing an ion optical axis C differ, and the sectional shapes are rotationally asymmetric around the ion optical axis C. Accordingly, as in the first embodiment, an acceptance shape in the pre-electrode section 32 is not circular but elliptical. Ellipticity of the ellipse can be adjusted with the radius of the pre-rod electrodes 32*b* and 32*d*.

Figure 6:
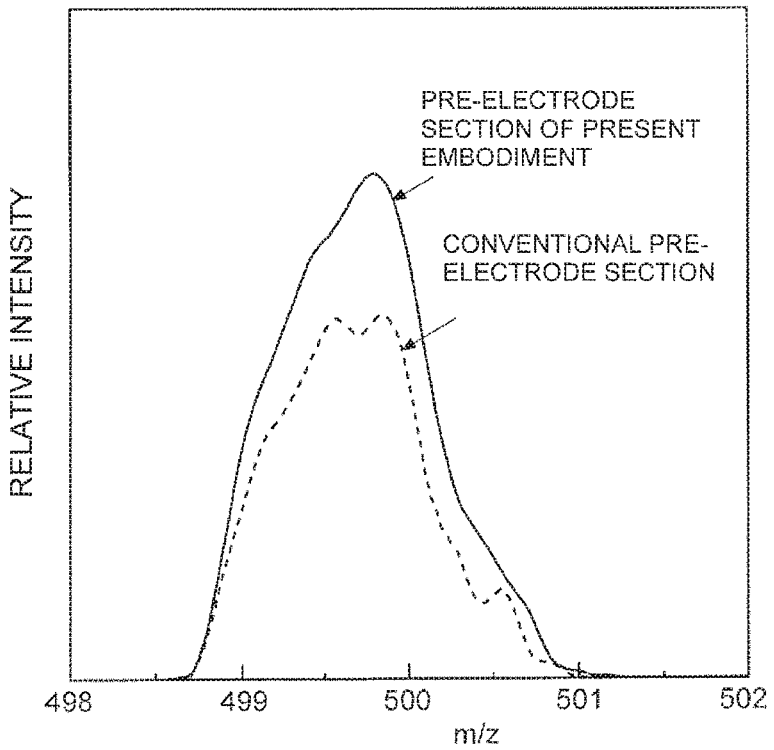
FIG. 6 is a diagram showing simulation results of relative ion intensity in a quadrupole mass filter in the mass spectrometer of the second embodiment and a conventional quadrupole mass filter.

FIG. 6 shows a comparison result of relative ion intensity by simulation calculations between the quadrupole mass filter used in the second embodiment and the conventional quadrupole mass filter. As is apparent from FIG. 6, the relative intensity of the quadrupole mass filter 3 in the second embodiment is about 1.3 to 1.4 times the relative intensity of the conventional quadrupole mass filter. This indicates that, as in the first embodiment, detection sensitivity can be improved also in this mass spectrometer of the second embodiment.

Third Embodiment

Figure 7:
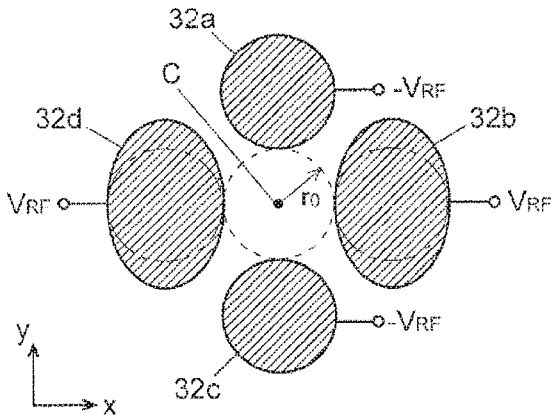
FIG. 7 is a longitudinal sectional view of pre-rod electrodes in a mass spectrometer of a third embodiment.

FIG. 7 is a longitudinal sectional view of a pre-electrode section 32 in a mass spectrometer that is another embodiment (third embodiment) of the present invention. A configuration other than the pre-electrode section 32 is completely the same as the configuration of the first embodiment. In this mass spectrometer of the third embodiment, all of four pre-rod electrodes 32*a* to 32*d* are in contact with a circle having a radius of $r_0$, but a sectional shape of the pre-rod electrodes 32*a* and 32*c* is circular, a sectional shape of the pre-rod electrodes 32*b* and 32*d* is elliptical. That is, sectional shapes of curved surfaces of the pre-rod electrodes 32*a* to 32*d* facing an ion optical axis C differ, and the sectional shapes are rotationally asymmetric around the ion optical axis C. Accordingly, as in the first embodiment, an acceptance shape in the pre-electrode section 32 is not circular but elliptical. Ellipticity of the ellipse can be adjusted with ellipticity of the pre-rod electrodes 32*b* and 32*d*.

Figure 8:
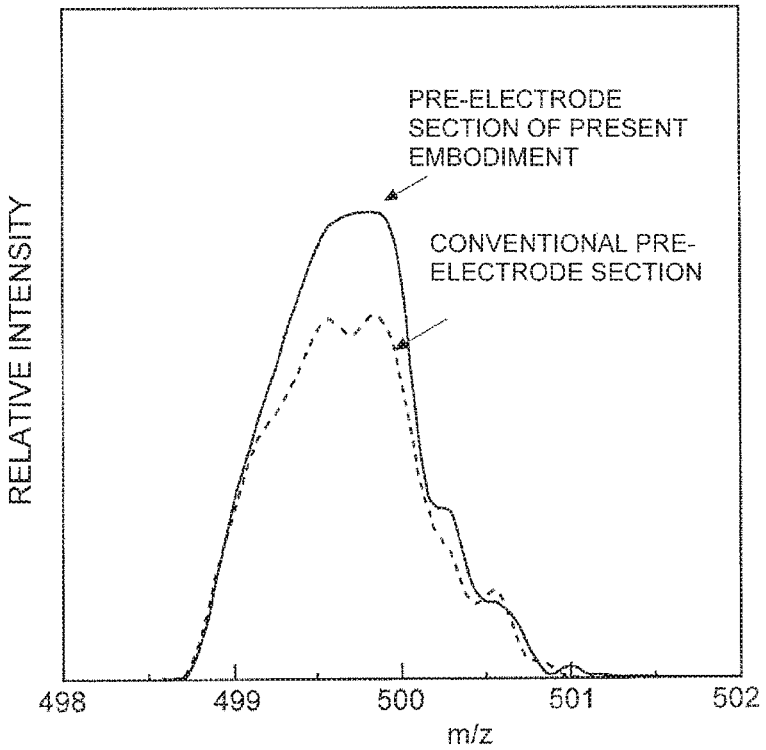
FIG. 8 is a diagram showing simulation results of relative ion intensity in a quadrupole mass filter in the mass spectrometer of the third embodiment and a conventional quadrupole mass filter.

FIG. 8 shows a comparison result of relative ion intensity by simulation calculations between the quadrupole mass filter used in the third embodiment and the conventional quadrupole mass filter. As is apparent from FIG. 8, the relative intensity of the quadrupole mass filter 3 in the third embodiment is about 1.3 times the relative intensity of the conventional quadrupole mass filter. This indicates that, as in the first embodiment, detection sensitivity can be improved also in this mass spectrometer of the third embodiment.

Fourth Embodiment

Figure 9:
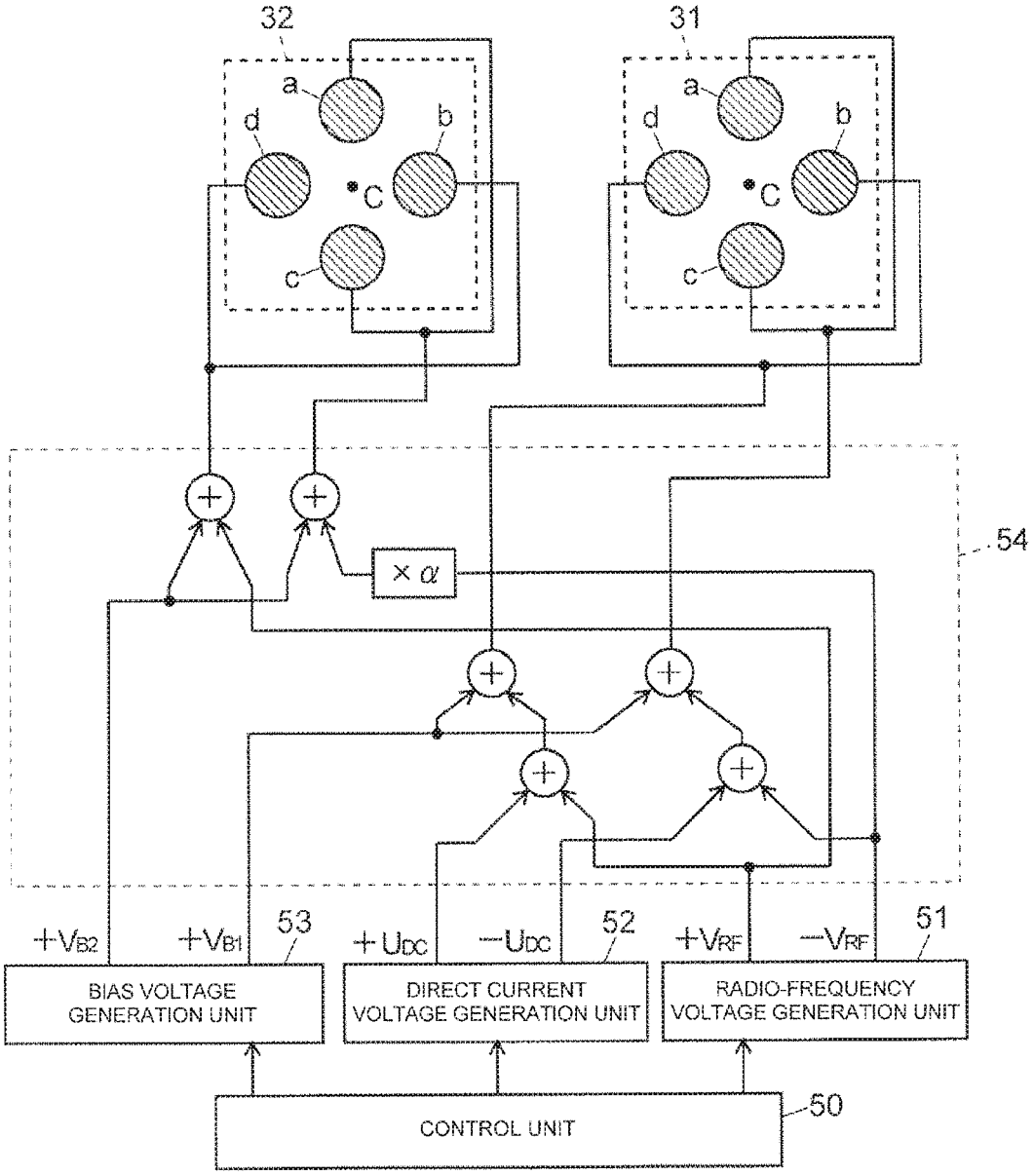
FIG. 9 is a configuration diagram of a quadruple mass filter and a voltage application unit in a mass spectrometer of a fourth embodiment.

FIG. 9 is a configuration diagram of a quadrupole mass filter and a voltage application unit in a mass spectrometer that is another embodiment (fourth embodiment) of the present invention. FIG. 9 illustrates a main electrode section 31 and a pre-electrode section 32 each on an x-y plane orthogonal to an ion optical axis C. In this mass spectrometer of the fourth embodiment, placement and shapes of pre-rod electrodes 32*a* to 32*d* are completely the same as conventional placement and shapes, but the configuration of the voltage application unit that applies voltages to the pre-rod electrodes 32*a* to 32*d* differs from conventional configuration.

As shown in FIG. 9, predetermined voltages are applied from the voltage application unit including a radio-frequency voltage generation unit 51, a direct current voltage generation unit 52, a bias voltage generation unit 53, and a voltage composition unit 54 to each of a total of eight rod electrodes included in the pre-electrode section 32 and the main electrode section 31.

In more detail, the radio-frequency voltage generation unit 51 generates radio-frequency voltages $+V_{RF}$ and $-V_{RF}$ having identical amplitude and an opposite phase according to a mass-to-charge ratio of ions to be selected, in response to an instruction from a control unit 50. The direct current voltage generation unit 52 generates direct current voltages $+U_{DC}$ and $-U_{DC}$ having an identical absolute value of voltage and an opposite polarity according to the mass-to-charge ratio of ions to be selected, in response to an instruction from the control unit 50. In addition, the bias voltage generation unit 53 generates predetermined direct current bias voltages $V_{B1}$ and $V_{B2}$ so as to produce an appropriate potential difference between these electrodes and electrodes or an ion optical system disposed in a preceding stage or subsequent stage in order to accelerate or decelerate ions. The voltage composition unit 54 includes adders that add voltages and an amplifier that amplifies (or reduces) a voltage. In this voltage composition unit 54, the positive-phase radio-frequency voltage $+V_{RF}$ and the positive-polarity direct current voltage $+U_{DC}$ are added, the opposite-phase radio-frequency voltage $-V_{RF}$ and the negative-polarity direct current voltage $-U_{DC}$ are added, and the direct current bias voltage $V_{B1}$ is further added to each of the voltages $\pm(U_{DC}+V_{RF})$. Then, resulting voltages are applied to the main rod electrodes 31*a* to 31*d* of the main electrode section 31. This is similar to the conventional general quadrupole mass filter.

In the voltage composition unit 54, the positive-phase radio-frequency voltage $+V_{RF}$ is added to the direct current bias voltage $V_{B2}$ and the resulting voltage is applied to the pre-rod electrodes 32*b* and 32*d*. In addition, the opposite-phase radio-frequency voltage $-V_{RF}$ is amplified by a factor of $\alpha$ by the amplifier and then added to the direct current bias voltage $V_{B2}$, and the resulting voltage is applied to the pre-rod electrodes 32*a* and 32*c*. That is, the voltage $V_{RF}+V_{B2}$ is applied to the two pre-rod electrodes 32*b* and 32*d* sandwiching the ion optical axis C, whereas the voltage $-\alpha V_{RF}+V_{B2}$ is applied to the other two pre-rod electrodes 32*a* and 32*c*. Accordingly, amplitude of the radio-frequency voltages to be applied to the pre-rod electrodes 32*a* to 32*d* becomes rotationally asymmetric around the ion optical axis C. Accordingly, as in the first embodiment, an acceptance shape in the pre-electrode section 32 is not circular but elliptical. Ellipticity of the ellipse can be adjusted with an amplification factor $\alpha$ of the amplifier.

Figure 10:
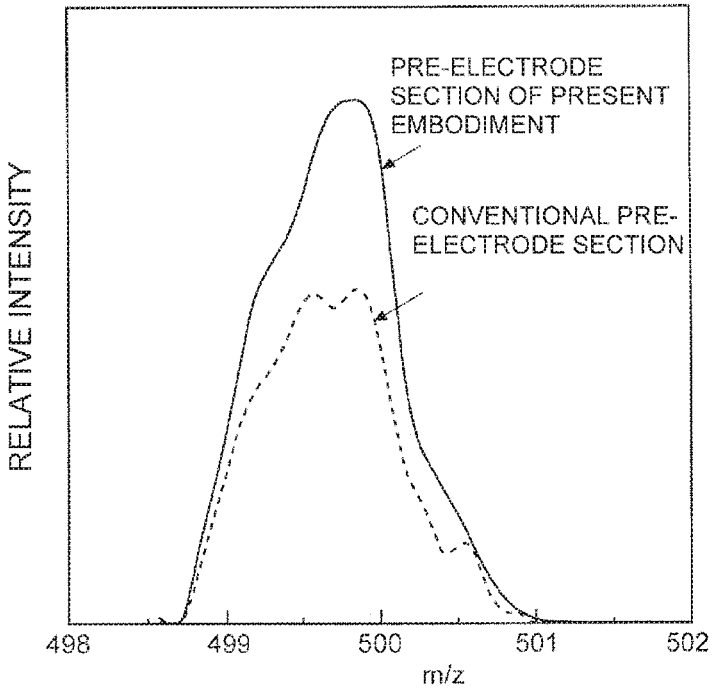
FIG. 10 is a diagram showing simulation results of relative ion intensity in the quadrupole mass filter in the mass spectrometer of the fourth embodiment and a conventional quadrupole mass filter.
Figure 11A:
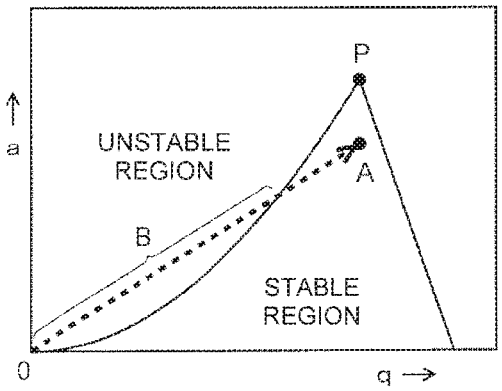
FIG. 11(*a*) is a stable region diagram showing motion conditions of ions passing through the quadrupole mass filter in a configuration in which the pre-rod electrodes are not provided.
Figure 11B:
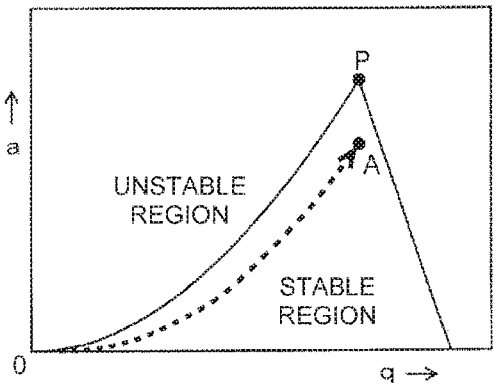

FIG. 10 shows a comparison result of relative ion intensity by simulation calculations between the quadrupole mass filter used in the fourth embodiment and the conventional quadrupole mass filter. As is apparent from FIG. 10, the relative intensity of the quadrupole mass filter 3 in the fourth embodiment is about 1.5 to 1.6 times the relative intensity of the conventional quadrupole mass filter. This indicates that, as in the first embodiment, detection sensitivity can be improved also in this mass spectrometer of the fourth embodiment.

Note that for easy understanding. FIG. 9 shows a configuration in which the voltage composition unit 54 including the adders and the amplifier generates the voltages to be applied to each of the rod electrodes; however, it is apparent that the circuit configuration for generating similar voltages is not limited to this configuration. A configuration may be used in which, for example, radio-frequency voltage waveforms are generated using digital data, after addition and multiplication are executed in a digital value stage, analog waveforms corresponding to the radio-frequency voltages are generated by performing digital-to-analog conversion, and these waveforms are applied to the rod electrodes via a drive circuit. Of course, other circuit configurations can also be easily considered.

In addition, the first to fourth embodiments are examples in which the quadrupole mass filter characteristic of the present invention is applied to the single type quadrupole mass spectrometer. Of course, this quadrupole mass filter may be applied to the preceding stage quadrupole mass filter and the subsequent stage quadrupole mass filter of the triple quadrupole mass spectrometer, and to the quadrupole mass filter of the Q-TOF mass spectrometer.

Furthermore, the above-described embodiments are only an example of the present invention, and it is natural that the embodiments are included in the claims of this application even if alterations, modifications, and additions are made as appropriate within the spirit of the present invention.

REFERENCE SIGNS LIST

1 . . . ion source
2 . . . ion lens
3 . . . quadrupole mass filter
31 . . . main electrode section
31*a* to 31*d* . . . main rod electrodes
32 . . . pre-electrode section
32*a* to 32*d* . . . pre-rod electrodes
4 . . . detector
50 . . . control unit
51 . . . radio-frequency voltage generation unit
52 . . . direct current voltage generation unit
53 . . . bias voltage generation unit
54 . . . voltage composition unit
C . . . ion optical axis (central axis)

The invention claimed is:

1. A quadrupole mass filter comprising:

a) a main electrode section including four main rod electrodes disposed to surround a central axis;

b) a pre-electrode section including pre-rod electrodes shorter than the main rod electrodes, the pre-rod electrodes being disposed in front of each of the main rod electrodes of the main electrode section along the central axis;

c) a first voltage application unit configured to apply, to each of the main rod electrodes, a voltage obtained by adding a direct current voltage and a radio-frequency voltage according to a mass-to-charge ratio of ions that are allowed to pass; and d) a second voltage application unit configured to apply, to each of the pre-rod electrodes, a radio-frequency voltage identical to the radio-frequency voltage in frequency, wherein in the pre-electrode section, first two of the pre-rod electrodes positioned so as to sandwich the central axis and second two of the pre-rod electrodes adjacent to the first two of the pre-rod electrodes around the central axis are disposed at positions where radii of inscribed circles centered on the central axis differ.

2. A quadrupole mass spectrometer comprising the quadrupole mass filter according to claim 1 used as a mass separator.

3. The quadrupole mass filter according to claim 1, wherein each of the pre-rod electrodes of has a same cross-sectional area.

4. The quadrupole mass filter according to claim 3, wherein the main rod electrodes of the main electrode section are disposed a same distance from the central axis.

* * * * *